US007299514B2

(12) United States Patent
Wu

(10) Patent No.: US 7,299,514 B2
(45) Date of Patent: Nov. 27, 2007

(54) FOLDABLE TOOL SET WITH CHAIN REPAIR TOOL

(76) Inventor: Shu Te Wu, No. 6, Lane 176, Wu Fu Road, Wu Feng Hsiang, Taichung Hsien (TW)

( * ) Notice: Subject to any disclaimer, the term of this patent is extended or adjusted under 35 U.S.C. 154(b) by 305 days.

(21) Appl. No.: 11/081,502

(22) Filed: Mar. 17, 2005

(65) Prior Publication Data

US 2005/0204721 A1 Sep. 22, 2005

(30) Foreign Application Priority Data

Mar. 18, 2004 (TW) ..... 93204123 U

(51) Int. Cl.

| | |
|---|---|
| ***B25B 13/00*** | (2006.01) |
| ***B25B 23/00*** | (2006.01) |
| ***B21L 9/06*** | (2006.01) |
| ***B21L 5/00*** | (2006.01) |

(52) U.S. Cl. ..... 7/138; 59/7; 59/11; 81/440

(58) Field of Classification Search ..... 59/7; 81/440; 7/138, 168

See application file for complete search history.

(56) References Cited

U.S. PATENT DOCUMENTS 5,140,736 A * 8/1992 Hsiao ..... 59/7
6,112,351 A * 9/2000 Hawkins et al. ..... 7/138
6,286,168 B1 * 9/2001 Woodruff et al. ..... 7/138
6,574,817 B2 * 6/2003 Wu ..... 7/138
6,751,819 B2 * 6/2004 Chuang ..... 7/168
6,988,288 B2 * 1/2006 Wang ..... 7/138

* cited by examiner

*Primary Examiner*—Derris H. Banks
*Assistant Examiner*—Teresa M. Bonk
(74) *Attorney, Agent, or Firm*—Troxell Law Office, PLLC

(57) ABSTRACT

The invention relates to a foldable tool set installed with a chain repair tool. The tool set has a housing and foldaway tools pivoted on the housing. The chain repair tool comprises a main body and an ejector pin screwed on top of the main body. The chain repair tool is pivoted on the tool set and can be folded within the tool set or lifted outward. In addition, an arm is included and one end of it is pivoted on one side of the chain repair tool to control movement of the chain repair tool. The chain repair tool and the arm are folded together in the housing. Accordingly, operation of disassembling and reassembling of chains can be conducted with this tool set without any other required tools.

5 Claims, 8 Drawing Sheets

FOLDABLE TOOL SET WITH CHAIN REPAIR TOOL

BACKGROUND OF THE INVENTION

The invention relates to a hand tool, and more particularly to a foldable tool set with a chain repair tool designed for bicycles providing better and more convenient features.

The foldable tool set is popular with bicycle lovers, thanks to its easiness to carry, availability of various sizes and types of tools, such as lug wrenches and screwdrivers. Some tool sets are mounted a chain repair tool that is used to disassemble and reassemble chains. Thus, users can utilize the tool set to repair their bicycles outdoors.

A conventional tool set with a chain repair tool 10 is shown in FIG. 1. A number of foldable tools 12 are pivoted on both ends of its casing 11. A chain repair tool is combined in this tool set. The chain repair tool comprises a main body 14 and an ejector pin 16 screwed in the main body. When placing a chain unto the body, use a lug wrench to rotate the ejector pin to push the pin on the joint of the chain for the purpose of disassembling and reassembling the chain.

A rod body 18 is extended from the main body 14 of the chain repair tool and is pivoted on the casing 11 of the tool set 10. Accordingly, a chain repair tool is installed on the foldable tool set. However, only the main body 14 and the ejector pin 16 can't achieve disassembly and reassembly of chains. As a result, a lug wrench not being part of the tool set is required to rotate the ejector pin 16. In other words, the operation of disassembling and reassembling chains can't be completed by merely single tool set.

Another conventional foldable tool set 20 with a chain repair tool is shown in FIG. 2. Likewise, multiple tools 22 are pivoted on both ends of the outer covering 21. One end of a rod 24 is pivoted to the casing 21 of the tool set and a profile of a ejector pin 25 is formed on the free end of the rod. The main body 26 of the chain repair tool is screwed unto the ejector pin 25. Therefore, a chain repair tool comes into existence and is attached to the foldable tool set. In addition, one small piece 28 is extended from the bottom of main body of the chain repair tool.

To operate this device, use fingers of one hand to grab the small piece 28 and rotate the casing 21 with the other hand to drive the ejector pin 25.

No extra tool is required to rotate the ejector pin 25 of the tool set 20 shown in FIG. 2, nevertheless, the strength implemented is limited and such operation is inconvenient. As the small piece 28 only provides limited space to grab and the holding strength of fingers is confined, operation efficiency is reduced greatly. It might be applicable to general chains of inferior quality; however, disassembling of chains with higher quality and precision like Shimano chains produced in Japan would be impossible. It is because the operation method derived from such structure won't be able to provide sufficient force. Thus, its application is even more limited than that shown in FIG. 1.

SUMMARY OF THE INVENTION

It is therefore a primary object of the present invention to provide a foldable tool set with a chain repair tool so that no extra tool is required while operating the chain repair tool and obtaining sufficient force to disassemble and reassemble chains.

It is a further object of the present invention to provide the foldable tool set that is folded in small volume.

The present invention can be best understood through the following description and accompanying drawings wherein:

DETAILED DESCRIPTION OF THE PREFERRED EMBODIMENTS

Figure 1:
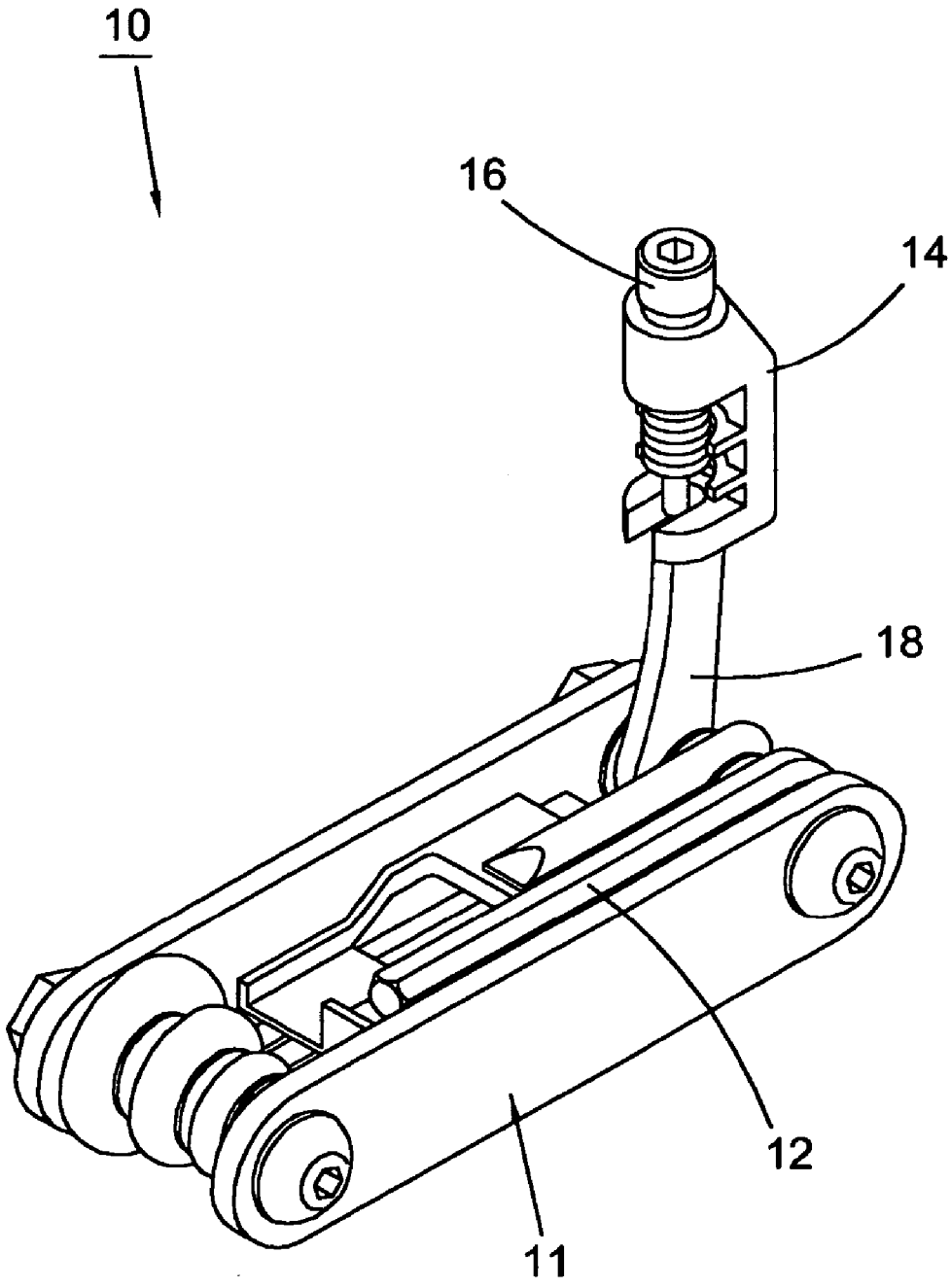
Fig. 1 PRIOR ART
FIG. 1 is a perspective view of a conventional foldable tool set.
Figure 2:
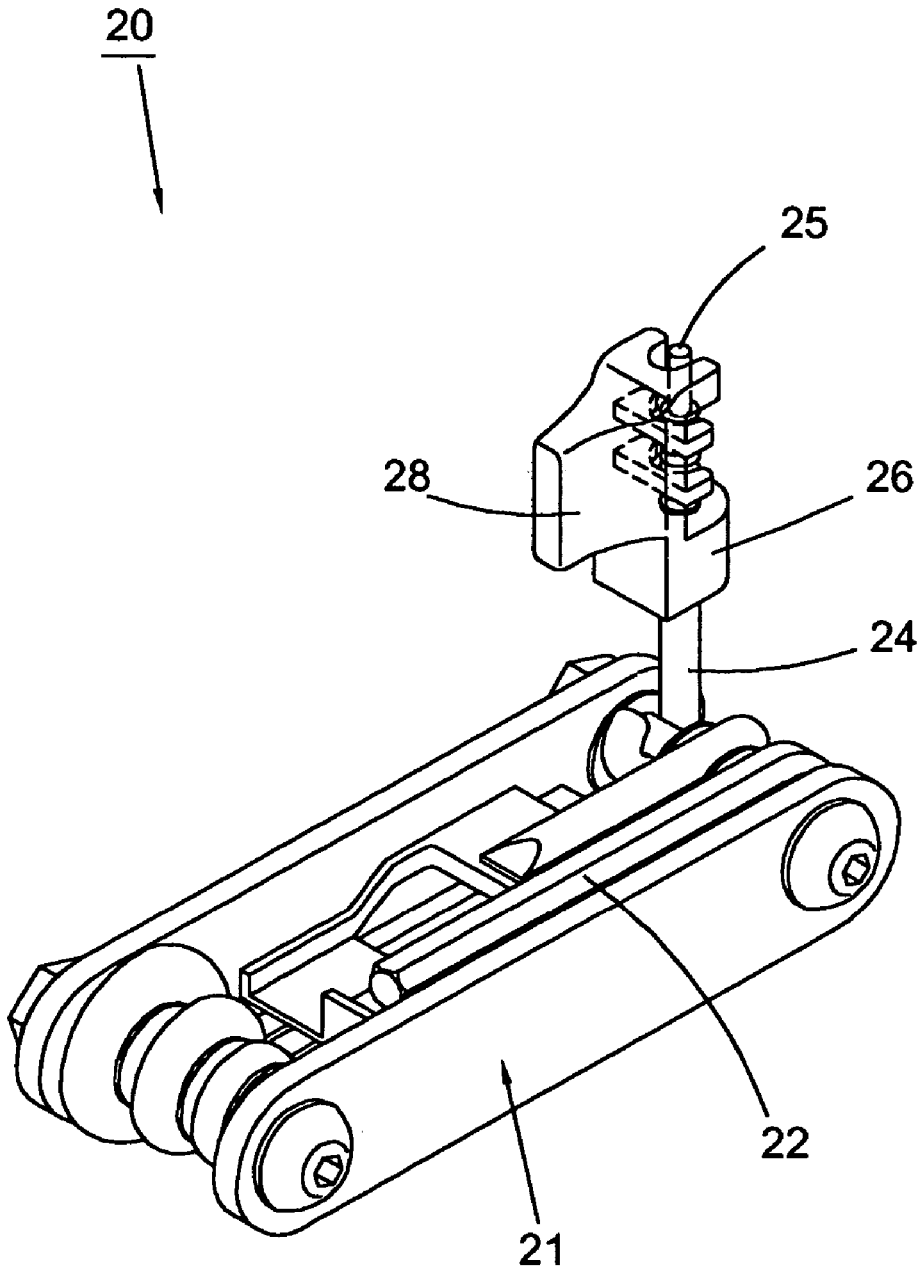
Fig. 2 PRIOR ART
FIG. 2 is a perspective view of another conventional foldable tool set.
Figure 3:
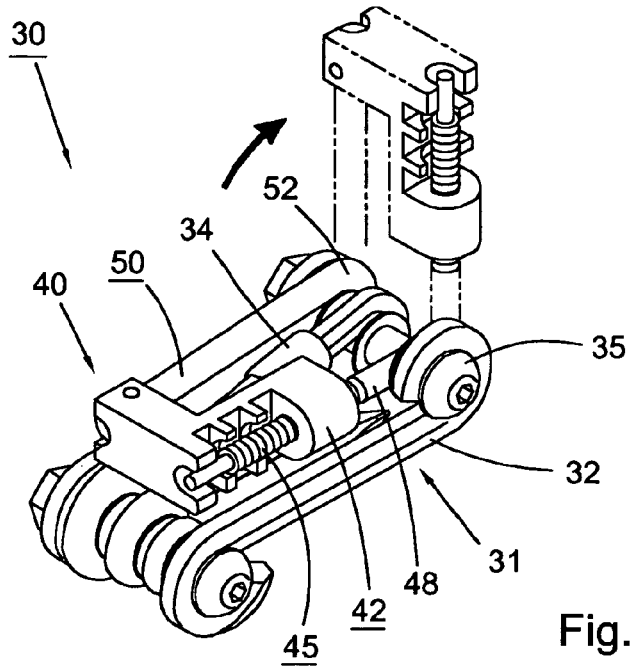
FIG. 3 is a perspective view of a preferred embodiment of the present invention and showing the tool set is collected.
Figure 4:
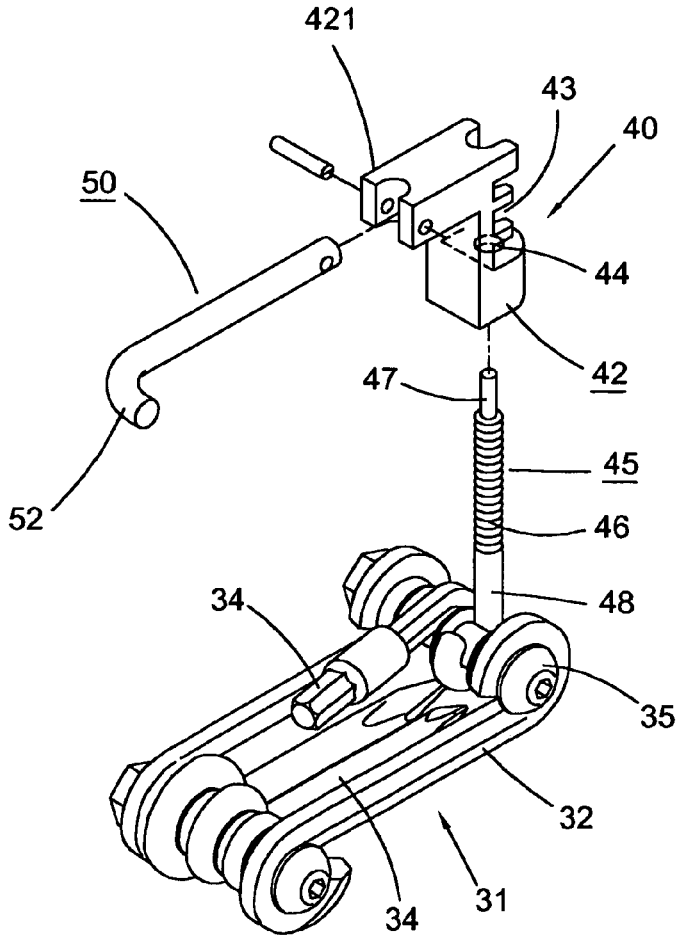
FIG. 4 is a perspective exploded view according to FIG. 3.

Please refer to FIGS. 3 and 4. According a first embodiment, the foldable tool set 30 of the present invention includes: a housing 31, multiple tools 34 and a chain repair tool 40.

Figure 13:
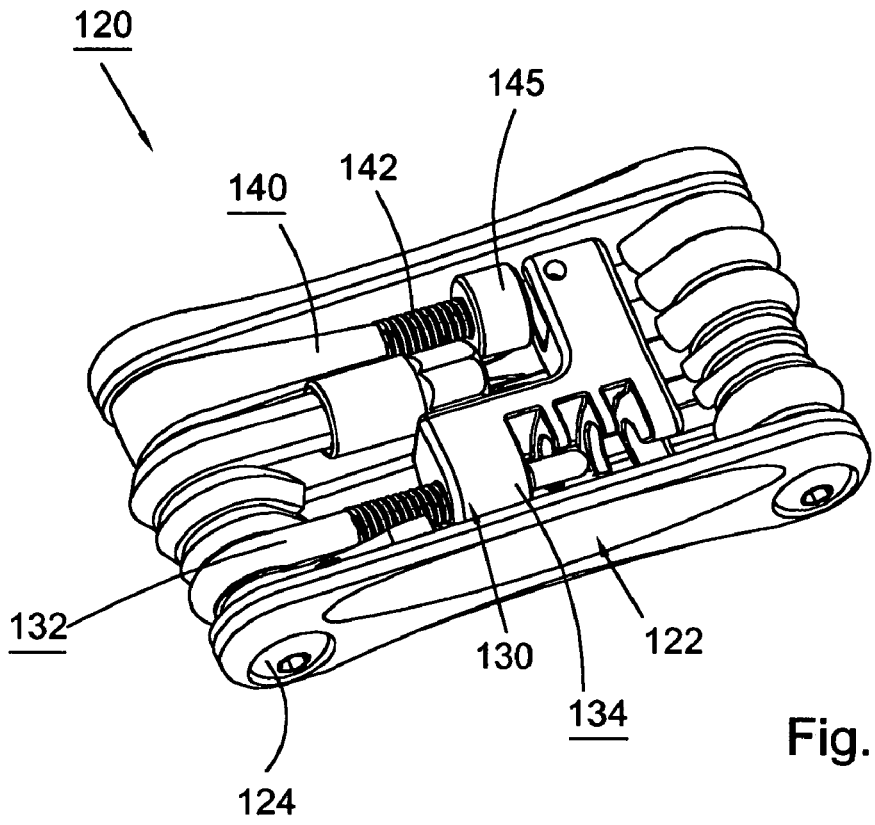
FIG. 13 is a perspective view of still another preferred embodiment of the present invention.

The housing 31 in this embodiment is constituted but not limited to one pair of parallel S-shape bars. Alternatively, it can be the housing 122 as shown in FIG. 13. A storage space is formed inside the housing.

The tools 34 are consisted of different sizes or types of tools, like lug wrenches, screwdrivers of different sizes or types, or knives or tools of other types. The tools 34 are pivoted to both ends of the housing 31 by two bolts 35 served as the fulcrum of rotation and facilitating folding towards the housing 31 or lifting outwards for use.

The chain repair tool 40 is consisted of a main body 42 and an ejector pin 45. A concave room 43 is formed on the top of the main body 42. A screwed hole 44 is formed on one end of the main body and communicating with the concave room 43. The ejector pin 45 has a bolt section 46. One end of the bolt section 46 is formed with a pin section 47, while the other end of the bolt section is mounted a connecting section 48. The ejector pin 45 is screwed in the screwed hole 44 of the main body 42 to facilitate the pin section 47 to enter the concave room 43. The chain repair tool 40 is pivoted unto a bolt 35 on one end of the housing 31 by the connecting section 48 so that the chain repair tool may be integrated with the tool set and foldable.

The present invention further comprises an arm 50, which is a lever, having one end pivoted to the free end of the main body 42 of the chain repair tool 40 and the other end made into an arc engaging section 52. There is an extension 421 on the bottom of the free end of the main body 42. One end of the arm 50 is pivoted between two lugs formed on the bottom of the extension 421.

In the structure exposed in this embodiment, one end (the ejector pin end) of the chain repair tool 40 is pivoted unto the housing 31 of the tool set and the other end (the main body end) is pivoted to the arm 50.

FIG. 3 illustrates that the chain repair tool 40 is folded inside the tool set 20 achieved by (the connecting section 48 of) the ejector pin 45 as a point of turning to fold it towards the housing 31. The arm 50 along with the chain repair tool 40 is folded into the housing. The arm 50 is about parallel to the ejector pin 45 and the engaging section 52 of the arm is stuck to one end of the tool set. Thus, the chain repair tool is folded and positioned upon the tool set.

Figure 5:
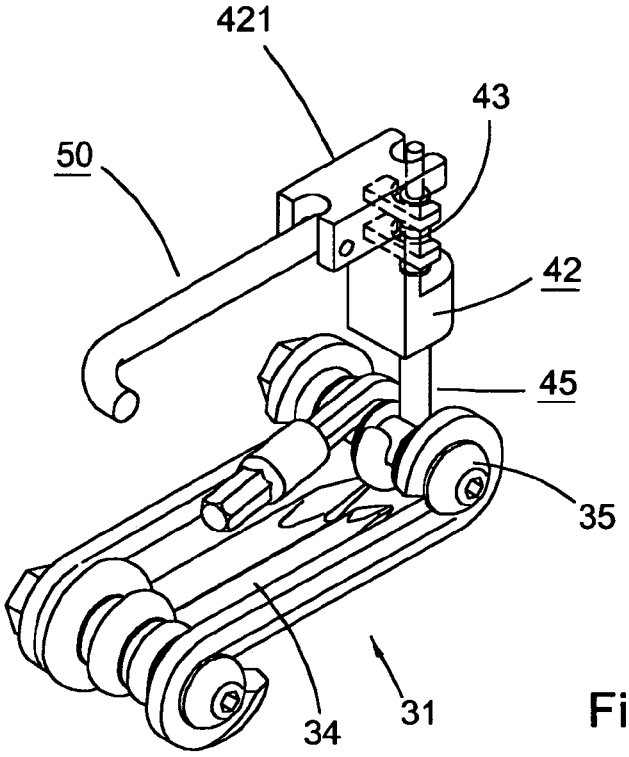
FIG. 5 shows the chain repair tool of FIG. 3 being pulled.
Figure 6:
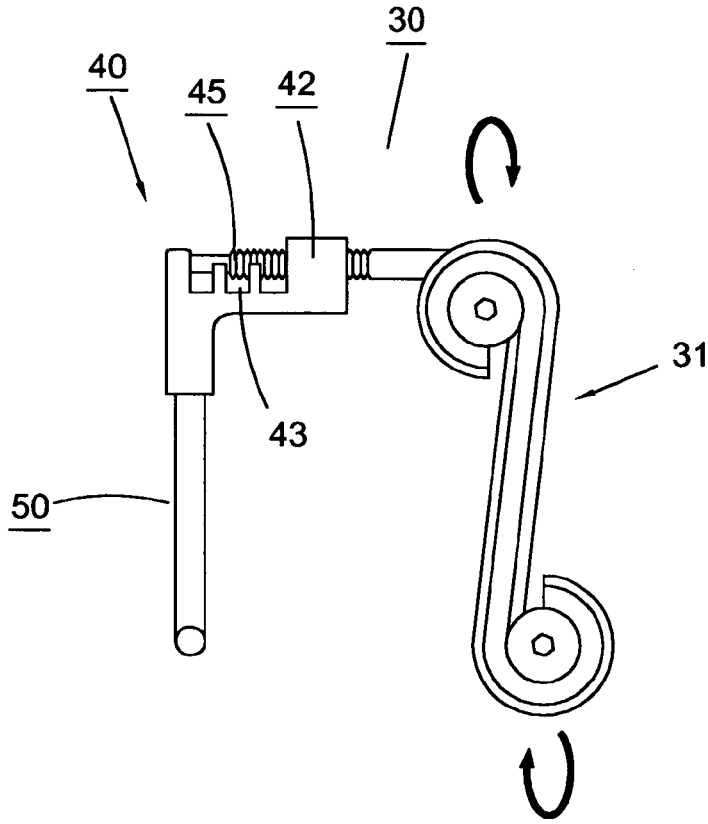
FIG. 6 is a view according to FIG. 3, showing the operation of the preferred embodiment.

Pull the chain repair tool 40 and the arm 50 outward shown as the imaginary line in FIG. 3 for use. Get the engaging section 52 of the arm 50 away from one end of the tool set and turn the tool 40 and arm 50 in a way as shown in FIG. 5. Referring to FIG. 6, place and position a chain in the concave room 43. Rotate the housing 31 to drive the ejector pin 45. When the pin section 47 pushes up the pin of the chain joint, the chain will be ready for disassembling or reassembling.

Figure 7:
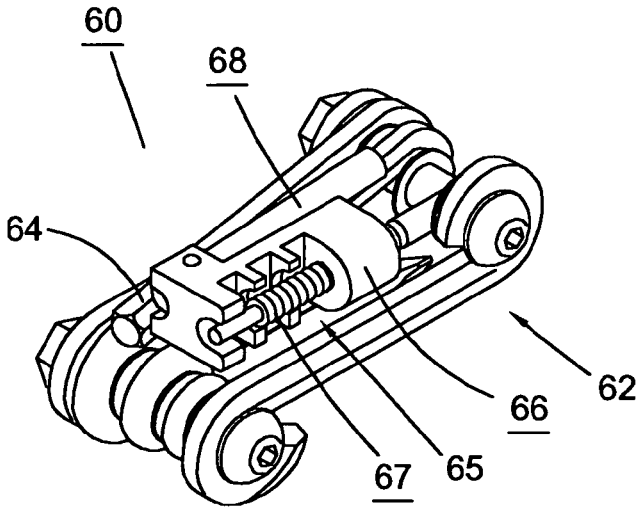
FIG. 7 is a perspective view of another preferred embodiment of the present invention.

FIG. 7 shows a second preferred embodiment of the present invention. Likewise, the foldable tool set 60 also consists of a housing 62, multiple tools 64 pivoted to both ends of the housing, a chain repair tool 65 (including a main body 66 and an ejector pin 67) and an arm 68. As installation of the chain repair tool 65 unto the tool set 60 is the same as that of the previous embodiment, no unnecessary details will be given.

There is no engaging section on the free end of the arm 68 in this embodiment. When the chain repair tool 65 is collected on the housing 62, the arm 68 is collected altogether and the arm and the chain repair tool are positioned side by side. As operation of this embodiment is identical to that shown in FIG. 6, no unnecessary details will be given.

Figure 8:
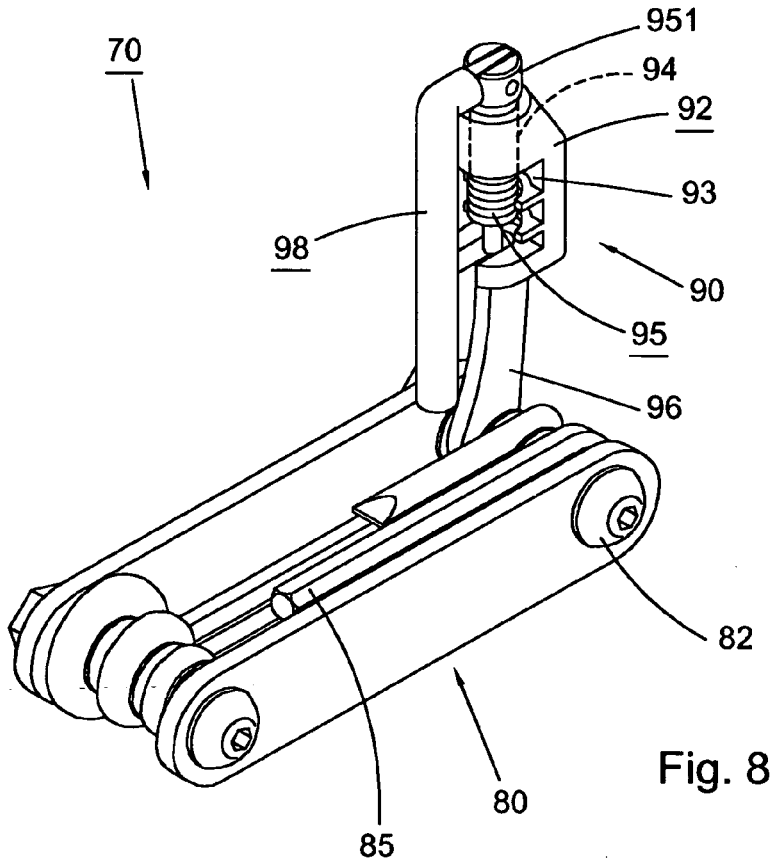
FIG. 8 is a perspective view of still another preferred embodiment of the present invention.

FIG. 8 is a third preferred embodiment of the foldable tool set 70 of the present invention.

A housing 80 has a storage space inside.

Multiple tools 85 are pivoted to bolts 82 on both ends of the housing respectively for folding or lifting outwardly.

A chain repair tool 90 has a main body 92 and an ejector pin 95. Likewise, there is a concave room 93 on top of the main body 92. A screwed hole 94 is formed in one end of the main body 92 and communicating with the concave room 93 for the ejector pin 95 being screwed in the screwed hole. A bar 96 is extended from the other end of the main body 92 of the chain repair tool and the bar is about parallel to the axial direction of the hole 94 approximately. The chain repair tool is folded inward in the tool set or lifted outward via the free end of the bar 96 pivoted to one end of the tool set.

Like the aforesaid, this embodiment also includes an arm 98. One end of the arm is pivoted to the outer end 951 of the ejector pin 95 for turning of the arm 98 relative to the chain repair tool.

In this embodiment, one end (the main body end) of the chain repair tool 90 is pivoted to the housing of the tool set and the other end (the ejector pin end) of the repair tool is pivoted with the arm 98.

Figure 9:
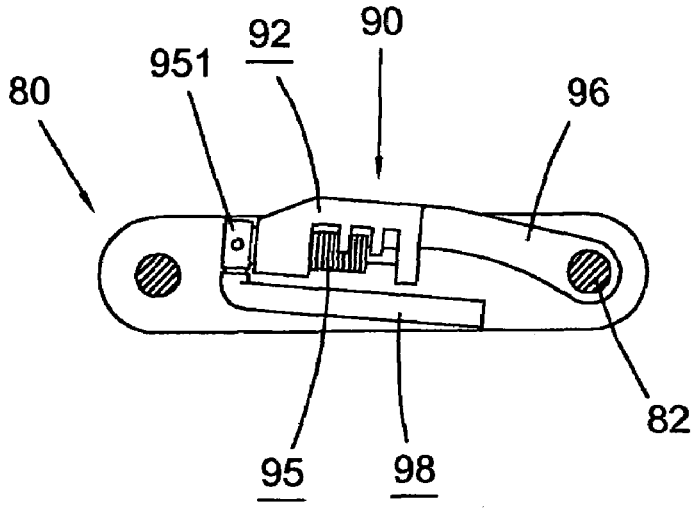
FIG. 9 is a sketch according to FIG. 8, showing that the preferred embodiment is collected.

Refer to FIG. 9 for folding and collecting the chain repair tool 90 and the arm 98 towards the tool set 70. The arm 98 is collected on the bottom of the chain repair tool 90 and folded towards the housing 80 together with the chain repair tool. The arm is about parallel to the longitudinal of the chain repair tool and the arm and the repair tool are side by side vertically. Besides, it is comprehensible that folding and collecting method is not limited to that shown in FIG. 9. Locate the arm at one side of the chain repair tool by turning the arm 98 and the ejector pin 95. In this way, the arm and the chain repair tool can be positioned side by side horizontally, as shown in FIG. 7, not vertically. Likewise, folding and collecting method of the embodiment in FIG. 7 may apply as shown in FIG.9, i.e., the arm 68 rested at the bottom of the chain repair tool 65 in a stacking way like FIG. 9 illustrates.

Figure 10:
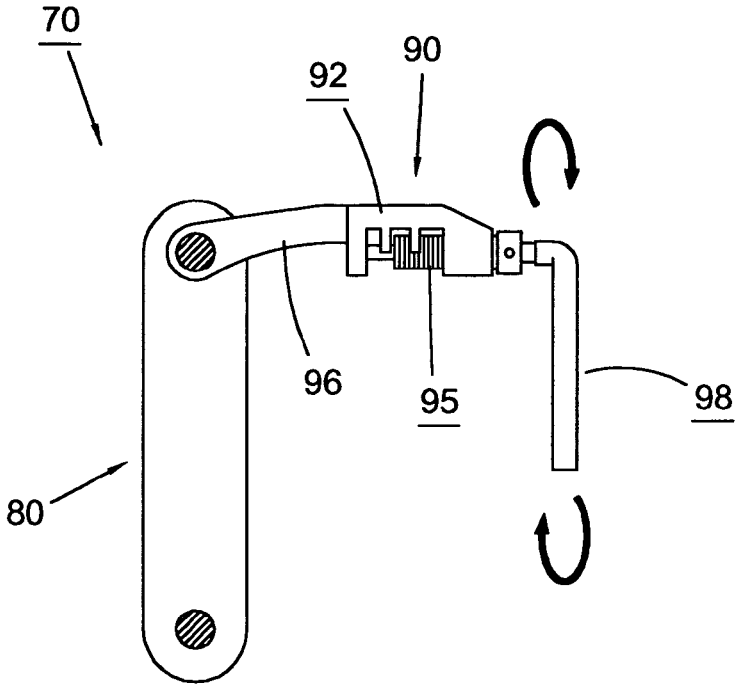
FIG. 10 is a view according to FIG. 8, showing the operation of the preferred embodiment.

Refer to FIG. 10 for operation of this embodiment. Grab the housing 80 with one hand and turn the arm 98 with the other hand to drive the ejector pin 95 for chain disassembly or reassembly.

Figure 11:
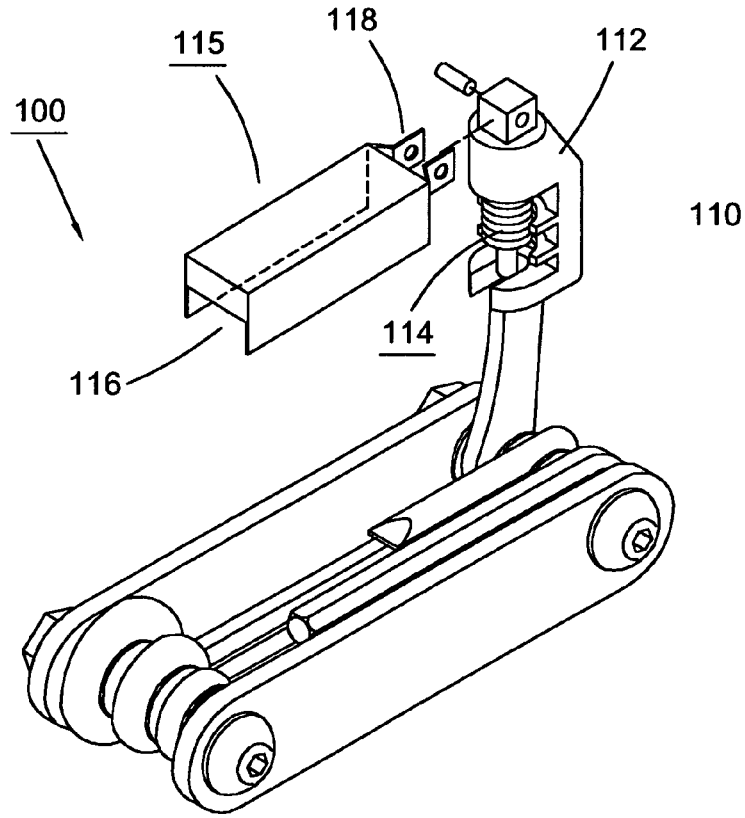
FIG. 11 is a perspective view of still another preferred embodiment of the present invention.

FIG. 11 illustrates the fourth preferred embodiment of this invention. The structure of the tool set 100 and the chain repair tool 110 is similar to that of the embodiment shown in FIG. 8. One end of the arm 115 is pivoted to the free end of the ejector pin 114 on the chain repair tool.

The arm 115 in this embodiment is a U-shaped lever of cross section to form an indented space 116. The arm 115 can be turned via two lugs 118 on one end of the arm pivoted to the free end of the ejector pin 114.

Figure 12:
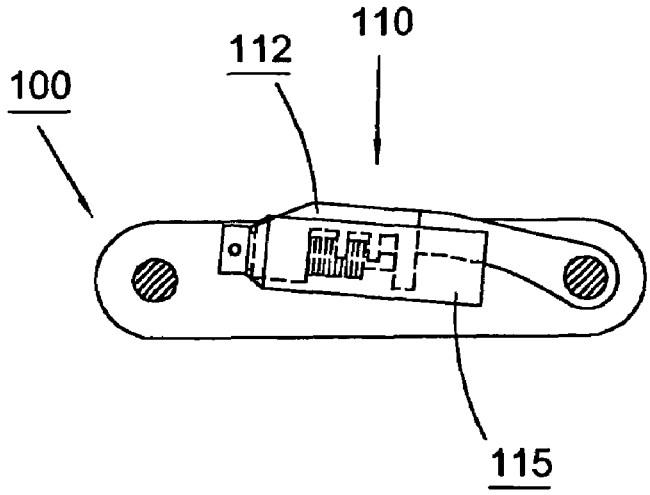
FIG. 12 is a sketch according to FIG. 11, showing that the preferred embodiment is collected.

In collecting the device, fold the arm 115 towards the chain repair tool 110 and then fold them together into the tool set 100 as FIG. 12 shows. Meanwhile, the main body 112 of the chain repair tool is collected in the indented space 116 so that storage space is economized.

FIG. 13 illustrates the fifth preferred embodiment of the foldable tool set 120 of the present invention. The structure of the tool set is similar to that of the first embodiment. The chain repair tool 130 is pivoted to one bolt 124 of the tool set 120 at one end of the ejector pin 132 and one end of the arm 140 is pivoted to the main body 134 of the chain repair tool.

Figure 14:
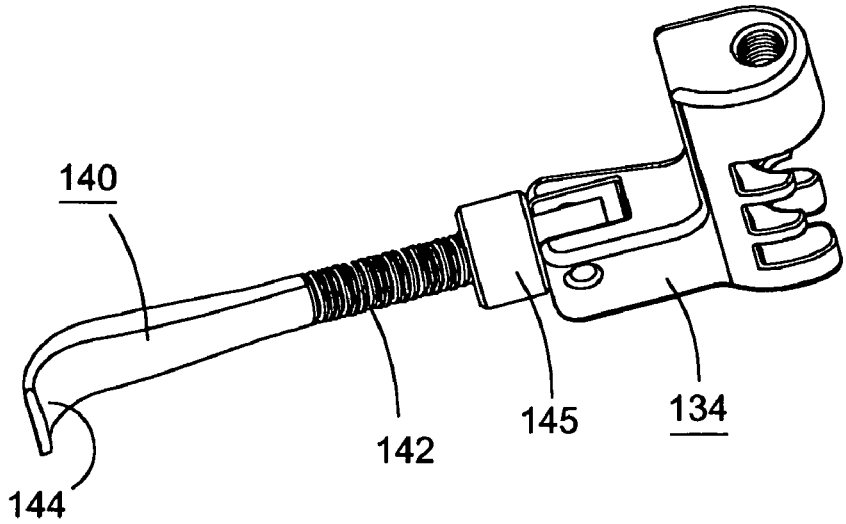
FIG. 14 is a perspective view of the chain repair tool and lever according to FIG. 13.

Threads 142 are formed on the circumference of the arm 140. A flat pull section 144 is formed on the free end of the arm as FIG. 14 shows. Furthermore, a nut 145 is screwed on the threads 142 of the arm. When the arm 140 is pulled outwardly from the main body 134 of the chain repair tool shown as FIG. 14, the arm may reach into the rim of a bicycle via the pull section 144 to get the tire out of the rim for repair. The arm 140 can be kept in position by rotating the nut 145 abutting against the main body 134.

Effects of this invention are listed as follows:

The tool used to drive the chain repair tool is integrated with the chain repair tool ingeniously in this invention and installed on the foldable tool set. Therefore, the single set of foldable tool set provided by this invention is capable of disassembling and reassembling chains. Users may accomplish the task of chain repair by merely carrying this tool set with them without any other tool.

Among the embodiments exposed by this invention, the arm is served as the resistance in the embodiments shown in FIGS. 3, 7 and 13 (Refer to FIG. 6 for operation.) providing sufficient length for users to grip. However, the arm is served as the effort in the embodiments shown in FIGS. 8 and 11 (Refer to FIG. 10 for operation.) providing enough length for users to turn, too. Grabbing and holding of the housing and the arm may generate sufficient torsion to disassemble and reassemble chains, which contributes to the capability of this invention in disassembling and reassembling various types of chains.

The chain repair tool and the arm are ingeniously installed on the tool set for easy collection. The integral tool set is streamlined, compact and easy to carry and store.

The above embodiments are only used to illustrate the present invention, not intended to limit the scope thereof. Many modifications of the above embodiments can be made without departing from the spirit of the present invention.

What is claimed is:

1. A foldable tool set with chain repair tool, comprising:

a housing having a storage space formed inside;

a predetermined numbers of tools being pivoted to at least one end of the housing, the tools can be folded towards the housing or lifted outward;

a chain repair tool having a main body and an ejector pin, a surface of the main body being formed a concave room, a screwed hole formed through one end of the main body and communicating with the concave room; the ejector pin having a bolt section, an inner end of the bolt section being formed a pin section, the ejector being screwed in the screwed hole of the main body so as the pin section can enter the concave room; the main body being a component unit formed on one end of the chain repair tool and the ejector pin being another component unit formed on another end of the chain repair tool, the one end of the chain repair tool being pivoted unto one end of the housing so that the chain repair tool being integrated with the tool set and being foldable inward and being able to pull outward; and further comprising:

an arm, which being a lever, one end of the arm being rotatably pivoted to the other end of the chain repair tool and being foldable towards the chain repair tool or being able to pull out from the repair tool; when the chain repair tool being folded into the tool set, the arm being folded into the housing together with the chain repair tool, the longitudinal of the arm is substantially parallel to the axial direction of the ejector pin when the arm is folded, wherein a connecting section is formed on the end of the ejector pin opposite the pin section and the chain repair tool being pivoted to one end of the housing by the connecting section; the arm is pivoted to the main body of the chain repair tool.

2. The foldable tool set as claimed in claim 1, wherein an engaging section is equipped at a free end of the arm so that the engaging section may get stuck on the one end of the tool set when the chain repair tool and the arm are collected in the housing.

3. The foldable tool set as claimed in claim 1, wherein an extension extrudes from the main body of the chain repair tool and one end of the arm is pivoted to the extension.

4. The foldable tool set as claim in claimed 1, wherein a flat pull section is equipped at a free end of the arm.

5. The foldable tool set as claimed in claim 1, wherein a circumference of the arm being formed with threads; further comprising: a nut being screwed on the threads of the arm; when the nut is moved towards the main body of the chain repair tool, the nut abutting against the main body.

* * * * *